US011490747B1

(12) United States Patent
Lo

(10) Patent No.: US 11,490,747 B1
(45) Date of Patent: Nov. 8, 2022

(54) MAGAZINE RACK WITH BUILDING BLOCK BASE BOARD

(71) Applicant: Ten Square Inc, Bethpage, NY (US)

(72) Inventor: Feng-Jung Lo, Bethpage, NY (US)

(73) Assignee: Ten Square Inc, Bethpage, NY (US)

( * ) Notice: Subject to any disclaimer, the term of this patent is extended or adjusted under 35 U.S.C. 154(b) by 0 days.

(21) Appl. No.: 17/568,876

(22) Filed: Jan. 5, 2022

(51) Int. Cl.
*A47F 7/00* (2006.01)
*A47F 5/10* (2006.01)
*A47F 7/14* (2006.01)

(52) U.S. Cl.
CPC ..... *A47F 7/0042* (2013.01); *A47F 5/10* (2013.01); *A47F 7/14* (2013.01)

(58) Field of Classification Search
CPC ..... A47F 7/0042; A47F 7/0014; A47F 7/14; A47F 5/10
USPC ..... 211/45
See application file for complete search history.

(56) References Cited

U.S. PATENT DOCUMENTS 4,162,731 A * 7/1979 DeGroot ..... A47B 47/06 211/186
4,270,816 A * 6/1981 Erickson ..... A47B 47/06 312/297
5,035,332 A * 7/1991 Stravitz ..... G11B 23/0236 211/184
5,086,934 A * 2/1992 Kelly ..... A47B 81/00 211/45
5,172,816 A * 12/1992 Kline ..... A47F 7/08 211/37
5,415,297 A * 5/1995 Klein ..... A47B 87/00
5,447,242 A * 9/1995 Kelly ..... A47F 7/145 D6/682.4
5,992,647 A * 11/1999 Malik ..... G11B 23/0236 211/40
6,032,965 A * 3/2000 Sabounjian ..... A47B 47/06 280/654
6,286,689 B1 * 9/2001 Sherwood ..... A47F 7/163 211/195
6,321,918 B1 * 11/2001 Rollins ..... G11B 33/0461 211/40
6,425,567 B2 * 7/2002 Schutze ..... A47B 19/06 248/452
D467,446 S * 12/2002 Brass ..... D6/407
D473,066 S * 4/2003 Kwok ..... D6/407
7,762,410 B2 * 7/2010 Colin ..... A47B 57/20 211/187
D852,490 S * 7/2019 De Loynes ..... D3/205
10,334,969 B1 * 7/2019 Roan ..... A47F 7/0042
D914,410 S * 3/2021 Lo ..... D6/675.3
11,109,674 B1 * 9/2021 Lo ..... F16B 5/02
11,246,409 B2 * 2/2022 Felsenthal ..... A47B 43/04
(Continued)

FOREIGN PATENT DOCUMENTS

DE 8915886 U1 * 2/1992

*Primary Examiner* — Stanton L Krycinski
(74) *Attorney, Agent, or Firm* — Karin L. Williams; Alan D. Kamrath; Mayer & Williams PC

(57) ABSTRACT

A magazine rack includes two opposite primary boards, two opposite secondary boards each assembled with one of the two primary boards, multiple connecting rods mounted between the two primary boards and mounted between the two secondary boards, and a bearing cloth unit mounted on the connecting rods. Thus, the bearing cloth unit is used to place books, newspapers or magazines for user's taking and reading.

2 Claims, 6 Drawing Sheets

(56) References Cited

U.S. PATENT DOCUMENTS

2002/0162815 A1* 11/2002 Wang ..... A47F 7/08
211/37
2004/0217076 A1* 11/2004 Gallagher ..... A47F 5/0018
211/186

* cited by examiner

MAGAZINE RACK WITH BUILDING BLOCK BASE BOARD

BACKGROUND OF THE INVENTION

1. Field of the Invention

The present invention relates to a rack or holder or stand or shelf and, more particularly, to a magazine (or newspaper) rack for placing books, newspapers, magazines or the like.

2. Description of the Related Art

A magazine rack is arranged in a public place, such as a library, a hospital or the like, for placing books, newspapers or magazines to facilitate a person taking and reading the books, newspapers or magazines. However, a conventional magazine rack has a fixed volume and cannot be folded or disassembled, thereby causing inconvenience in packaging, transportation and storage. In addition, the conventional magazine rack does not present variation in model or profile, thereby decreasing the aesthetic quality.

BRIEF SUMMARY OF THE INVENTION

The primary objective of the present invention is to provide a magazine rack that presents a model of a building block.

In accordance with the present invention, there is provided a magazine rack comprising two primary boards, two secondary boards, multiple connecting rods, a bearing cloth unit, and multiple fastening members. Each of the two primary boards has a primary board body. The primary board body has an end provided with an extension. The primary board body and the extension are provided with multiple first projections formed on the same face thereof. Each of the first projections has a cylindrical shape. The first projections present a matrix arrangement. The primary board body is provided with multiple first through holes penetrating some of the first projections. The primary board body is provided with multiple first slots arranged opposite to the first projections. Each of the first slots is connected to one of the first through holes. The extension is provided with multiple perforations penetrating some of the first projections. The two primary boards are spaced and opposite to each other. Each of the two secondary boards has a secondary board body. The secondary board body has an end provided with a recess. The secondary board body has a first face provided with multiple second projections. Each of the second projections has a cylindrical shape. The second projections present a matrix arrangement. The secondary board body is provided with multiple second through holes penetrating some of the second projections. The secondary board body has a second face provided with multiple second slots arranged opposite to the second projections. Each of the second slots is connected to one of the second through holes. The second face of the secondary board body is provided with multiple inserts arranged opposite to the second projections. Each of the inserts aligns with one of the second projections. Each of the inserts is provided with a threaded connecting hole. Each of the two secondary boards is mounted on one of the two primary boards. The extension of each of the two primary boards is inserted into the recess of one of the two secondary boards. The inserts of each of the two secondary boards are respectively inserted into the perforations of one of the two primary boards, with the connecting hole being connected to one of the perforations.

The two secondary boards are spaced and opposite to each other. Some of the connecting rods are mounted between the two primary boards, and each of the connecting rods has two ends each inserted into one of the first slots of each of the two primary boards. Other of the connecting rods are mounted between the two secondary boards, and each of the connecting rods has two ends each inserted into one of the second slots of each of the two secondary boards. The bearing cloth unit is mounted on the connecting rods. Some of the fastening members extend through the perforations of each of the two primary boards and are screwed into and locked in the connecting holes of the inserts of each of the two secondary boards, to secure each of the two primary boards with each of the two secondary boards. Other of the fastening members extend through the first through holes of each of the two primary boards or the second through holes of each of the two secondary boards and are locked in the two ends of each of the connecting rods, to secure the connecting rods with the two primary boards and the two secondary boards.

According to the primary advantage of the present invention, the magazine rack is assembled and disassembled easily, quickly, and conveniently.

According to another advantage of the present invention, the two primary boards, the two secondary boards, the connecting rods, and the bearing cloth unit are stacked together after the magazine rack is disassembled, to facilitate packaging, storage, and transportation.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
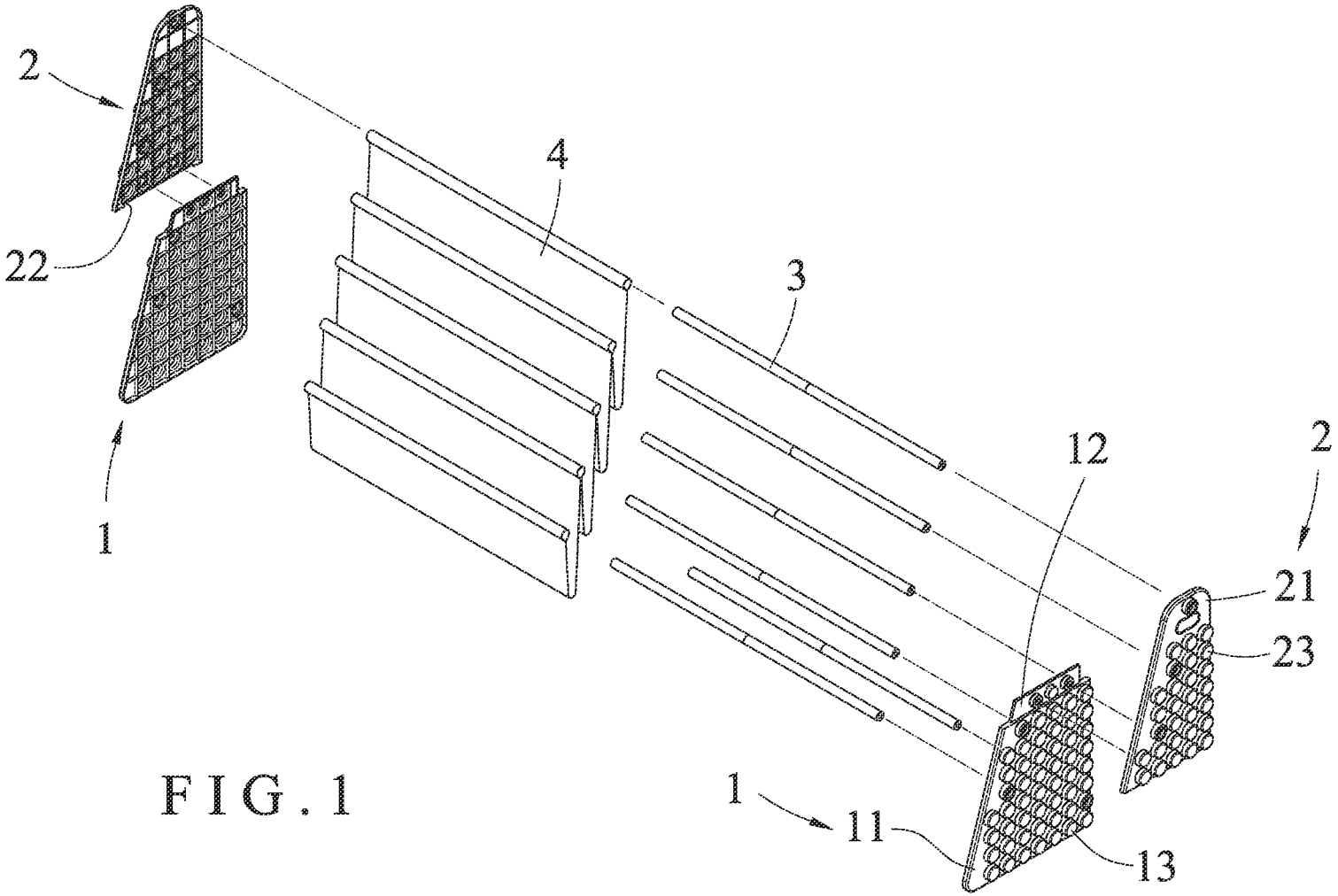
FIG. 1 is an exploded perspective view of a magazine rack in accordance with the preferred embodiment of the present invention.
Figure 2:
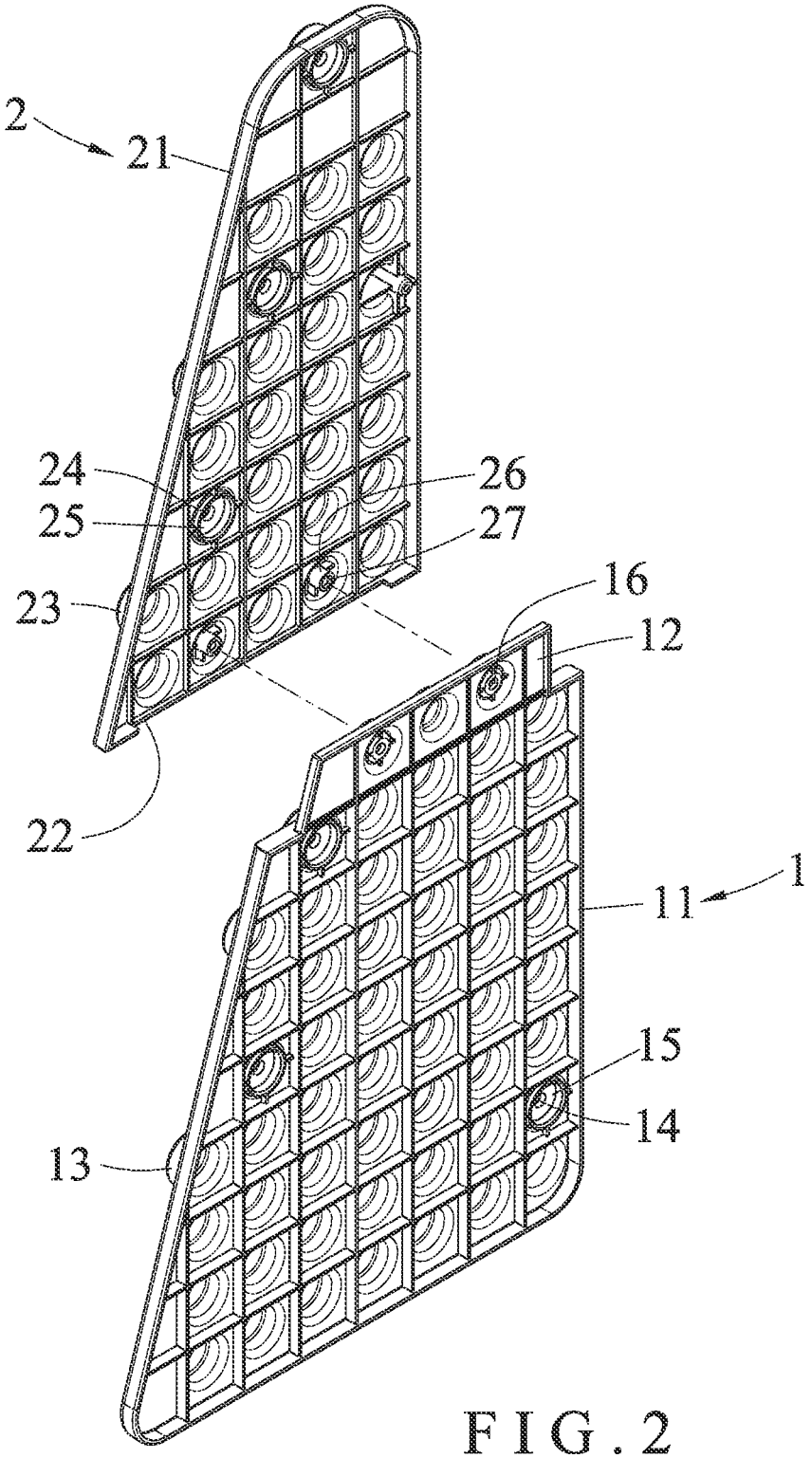
FIG. 2 is a locally enlarged view of the magazine rack as shown in FIG. 1.
Figure 3:
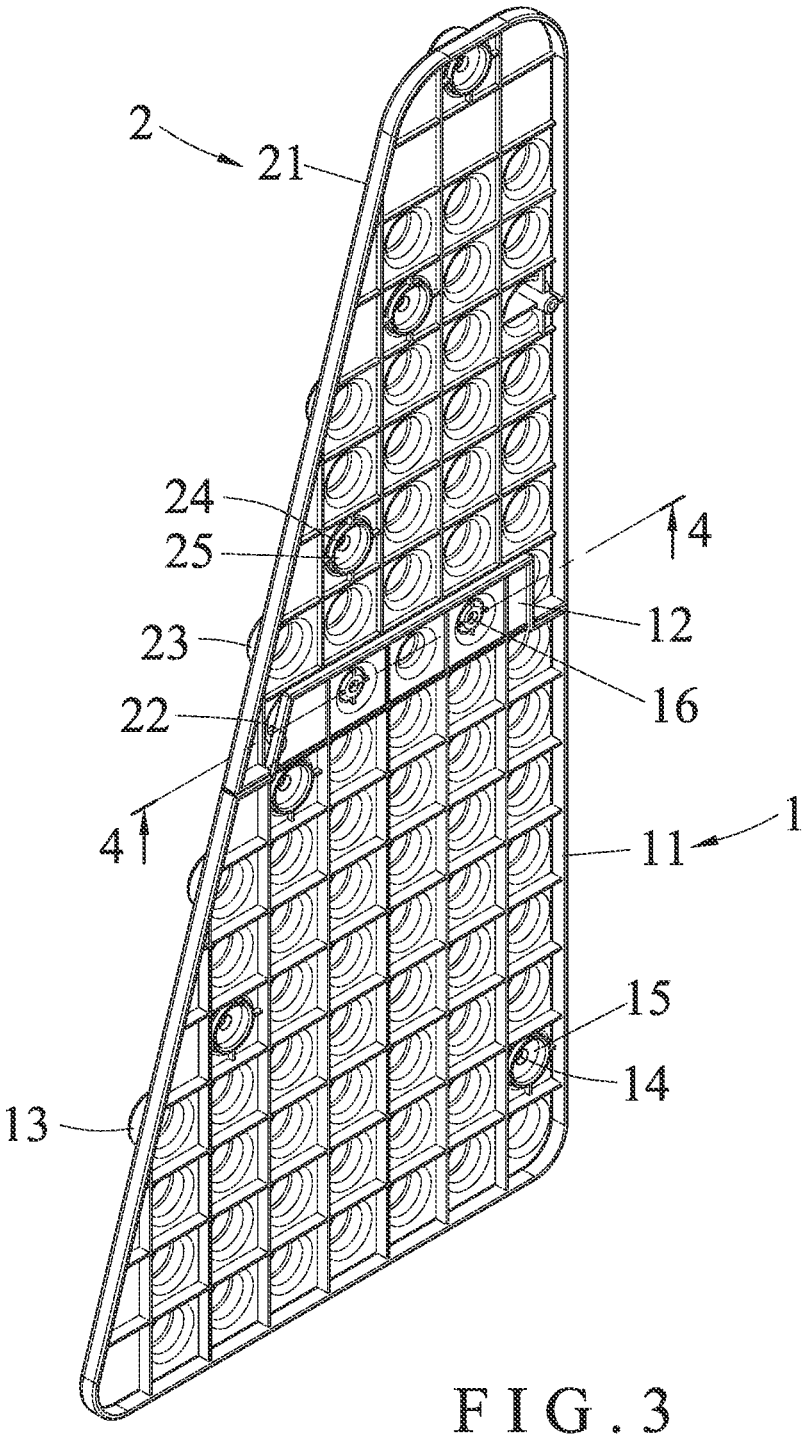
FIG. 3 is a perspective assembly view of the magazine rack as shown in FIG. 2.
Figure 4:
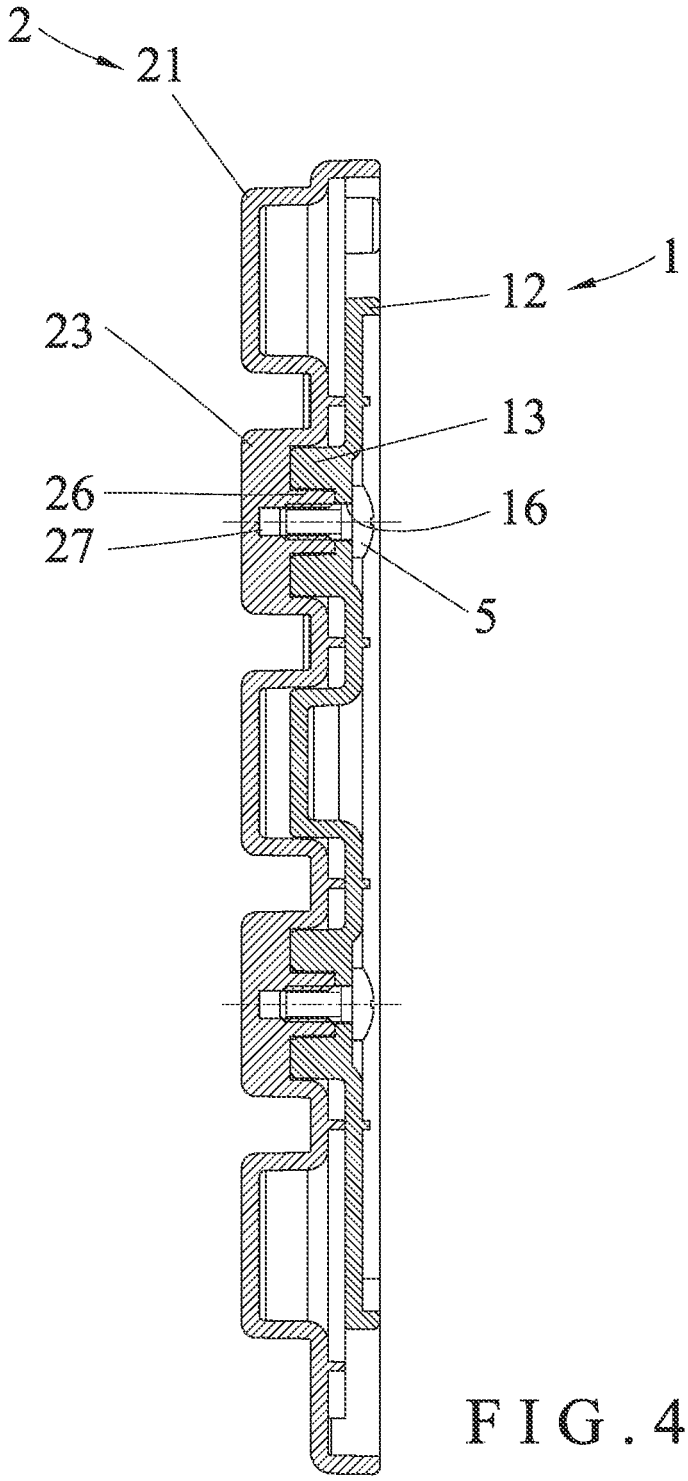
FIG. 4 is a cross-sectional view of the magazine rack taken along line 4-4 as shown in FIG. 3.
Figure 5:
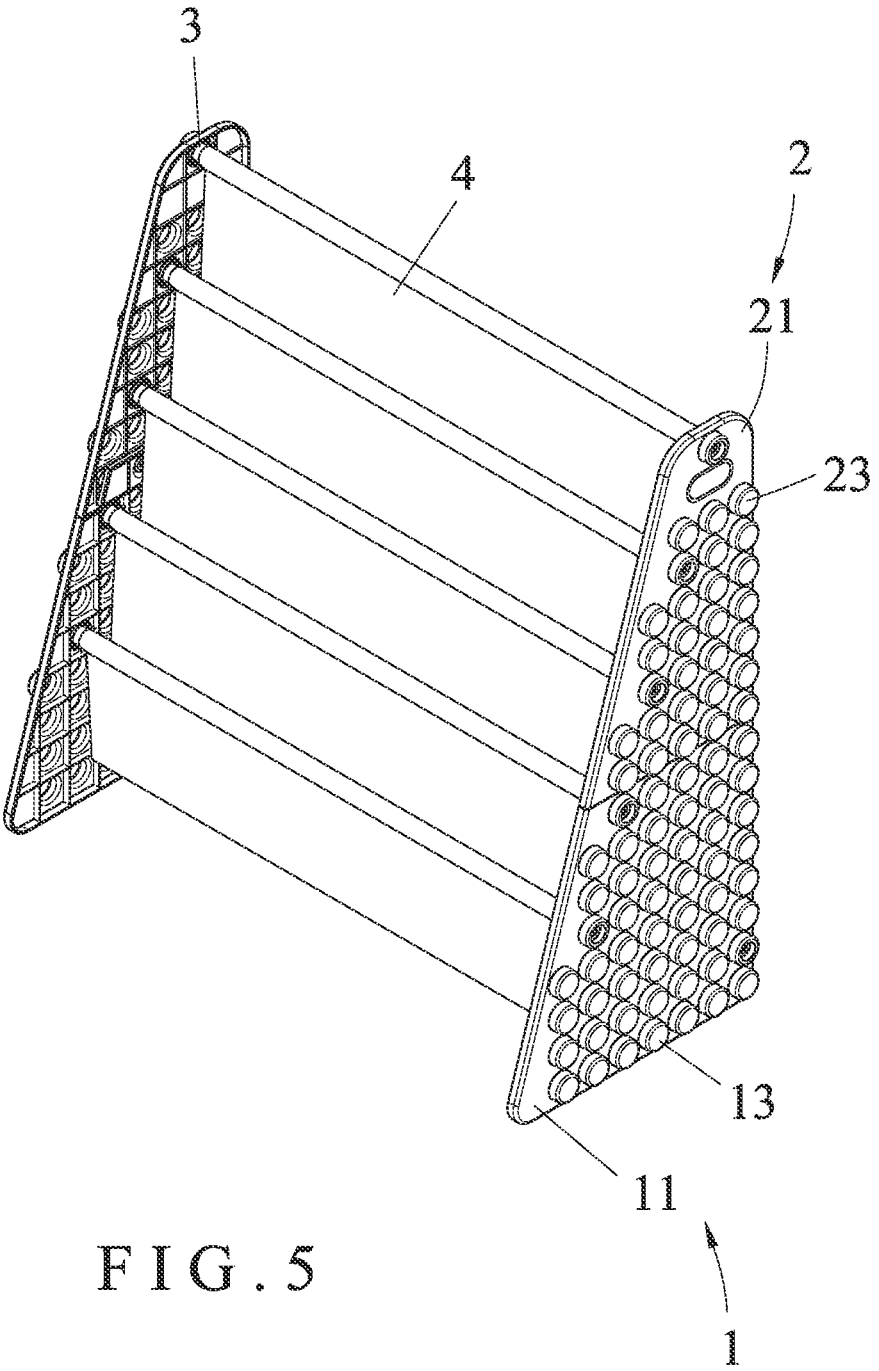
FIG. 5 is a perspective view of the magazine rack in accordance with the preferred embodiment of the present invention.

Referring to the drawings and initially to FIGS. 1-5, a magazine rack in accordance with the preferred embodiment of the present invention comprises two primary boards 1, two secondary boards 2, multiple connecting rods 3, a bearing cloth unit 4, and multiple fastening members 5.

Each of the two primary boards 1 has a primary board body 11. The primary board body 11 has an end provided with an extension 12 extending upward. The primary board body 11 and the extension 12 are provided with multiple first projections 13 formed on the same face thereof. Each of the first projections 13 has a cylindrical shape. The first projections 13 present a matrix arrangement. The primary board body 11 is provided with multiple first through holes 14 penetrating some of the first projections 13. The primary board body 11 is provided with multiple first slots 15 arranged opposite to the first projections 13. Each of the first slots 15 is connected to one of the first through holes 14. The extension 12 is provided with multiple perforations 16 penetrating some of the first projections 13. The two primary boards 1 are spaced and opposite to each other.

Each of the two secondary boards 2 has a secondary board body 21. The secondary board body 21 has an end provided with a recess 22. The secondary board body 21 has a first face provided with multiple second projections 23. Each of the second projections 23 has a cylindrical shape. The second projections 23 present a matrix arrangement. The secondary board body 21 is provided with multiple second through holes 24 penetrating some of the second projections 23. The secondary board body 21 has a second face provided with multiple second slots 25 arranged opposite to the second projections 23. Each of the second slots 25 is connected to one of the second through holes 24. The second face of the secondary board body 21 is provided with multiple inserts 26 arranged opposite to the second projections 23. Each of the inserts 26 aligns with one of the second projections 23. Each of the inserts 26 is provided with a threaded connecting hole 27. The two secondary boards 2 are spaced and opposite to each other.

In assembly, each of the two secondary boards 2 is mounted on one of the two primary boards 1. The extension 12 of each of the two primary boards 1 is inserted into the recess 22 of one of the two secondary boards 2. The inserts 26 of each of the two secondary boards 2 are respectively inserted into the perforations 16 of one of the two primary boards 1, with the connecting hole 27 being connected to one of the perforations 16.

Some of the connecting rods 3 are mounted between the two primary boards 1, and each of the connecting rods 3 has two ends each inserted into one of the first slots 15 of each of the two primary boards 1. Other of the connecting rods 3 are mounted between the two secondary boards 2, and each of the connecting rods 3 has two ends each inserted into one of the second slots 25 of each of the two secondary boards 2. Each of the two ends of each of the connecting rods 3 has an inner thread.

The bearing cloth unit 4 is mounted on the connecting rods 3.

Some of the fastening members 5 extend through the perforations 16 of each of the two primary boards 1 and are screwed into and locked in the connecting holes 27 of the inserts 26 of each of the two secondary boards 2, to secure each of the two primary boards 1 with each of the two secondary boards 2. Other of the fastening members 5 extend through the first through holes 14 of each of the two primary boards 1 or the second through holes 24 of each of the two secondary boards 2 and are screwed into and locked in the two ends of each of the connecting rods 3, to secure the connecting rods 3 with the two primary boards 1 and the two secondary boards 2.

In the preferred embodiment of the present invention, the two primary boards 1 are arranged symmetrically, and the two secondary boards 2 are arranged symmetrically.

In such a manner, each of the two primary boards 1 is provided with multiple first projections 13 which present a matrix arrangement, while each of the two secondary boards 2 is provided with multiple second projections 23 which present a matrix arrangement, so that the two primary boards 1 and the two secondary boards 2 present a building block model or configuration to enhance the aesthetic quality of the magazine rack. After the magazine rack is assembled, the bearing cloth unit 4 is used to place books, newspapers, magazines or the like.

Figure 6:
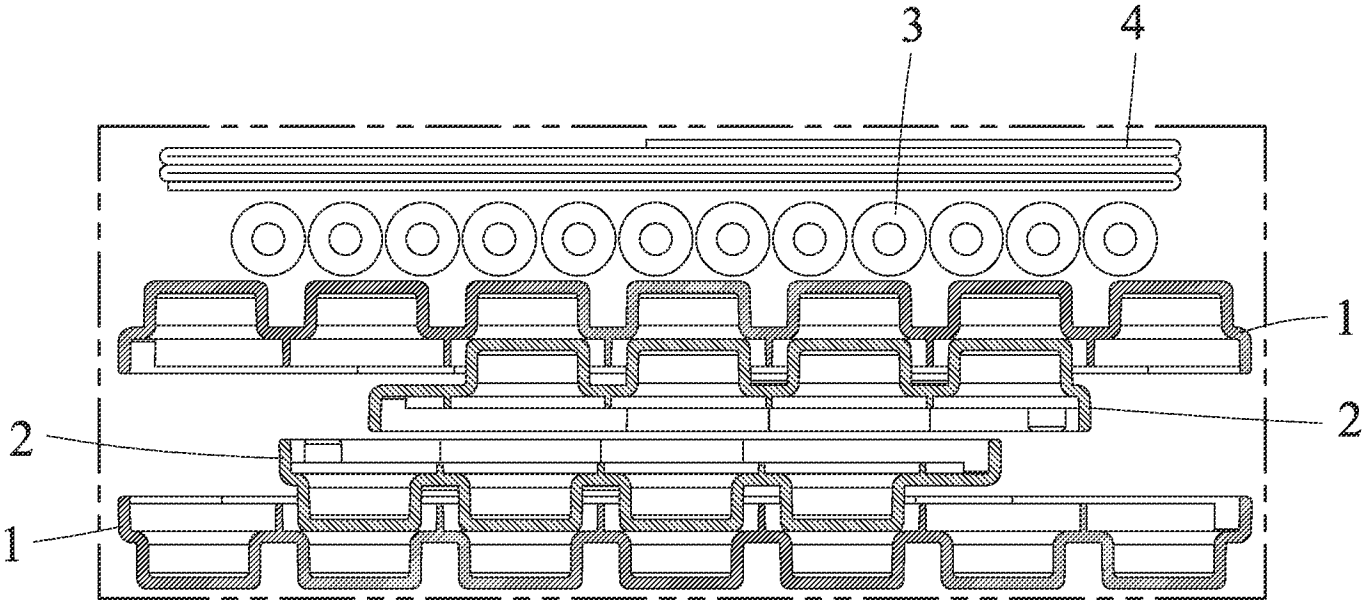
FIG. 6 is a cross-sectional view showing stacking of the parts in a box after the magazine rack is disassembled.

Referring to FIG. 6 with reference to FIGS. 1-5, when the magazine rack is disassembled, the two primary boards 1, the two secondary boards 2, the connecting rods 3, and the bearing cloth unit 4 are stacked in a box, to save the space of storage, and to facilitate packaging, storage, and transportation.

Accordingly, the magazine rack is assembled and disassembled easily, quickly, and conveniently. In addition, the two primary boards 1, the two secondary boards 2, the connecting rods 3, and the bearing cloth unit 4 are stacked together after the magazine rack is disassembled, to facilitate packaging, storage, and transportation.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A magazine rack comprising:

two primary boards, two secondary boards, multiple connecting rods, a bearing cloth unit, and multiple fastening members;

wherein:

each of the two primary boards has a primary board body;

the primary board body has an end provided with an extension;

the primary board body and the extension are provided with multiple first projections formed on the same face thereof;

each of the first projections has a cylindrical shape;

the first projections present a matrix arrangement;

the primary board body is provided with multiple first through holes penetrating some of the first projections;

the primary board body is provided with multiple first slots arranged opposite to the first projections;

each of the first slots is connected to one of the first through holes;

the extension is provided with multiple perforations penetrating some of the first projections;

the two primary boards are spaced and opposite to each other;

each of the two secondary boards has a secondary board body;

the secondary board body has an end provided with a recess;

the secondary board body has a first face provided with multiple second projections;

each of the second projections has a cylindrical shape;

the second projections present a matrix arrangement;

the secondary board body is provided with multiple second through holes penetrating some of the second projections;

the secondary board body has a second face provided with multiple second slots arranged opposite to the second projections;

each of the second slots is connected to one of the second through holes;

the second face of the secondary board body is provided with multiple inserts arranged opposite to the second projections;

each of the inserts aligns with one of the second projections;

each of the inserts is provided with a threaded connecting hole;

each of the two secondary boards is mounted on one of the two primary boards;

the extension of each of the two primary boards is inserted into the recess of one of the two secondary boards;

the inserts of each of the two secondary boards are respectively inserted into the perforations of one of the two primary boards, with the connecting hole being connected to one of the perforations;

the two secondary boards are spaced and opposite to each other;

some of the connecting rods are mounted between the two primary boards, and each of the connecting rods has two ends each inserted into one of the first slots of each of the two primary boards;

other of the connecting rods are mounted between the two secondary boards, and each of the connecting rods has two ends each inserted into one of the second slots of each of the two secondary boards;

the bearing cloth unit is mounted on the connecting rods;

some of the fastening members extend through the perforations of each of the two primary boards and are screwed into and locked in the connecting holes of the inserts of each of the two secondary boards, to secure each of the two primary boards with each of the two secondary boards; and other of the fastening members extend through the first through holes of each of the two primary boards or the second through holes of each of the two secondary boards and are locked in the two ends of each of the connecting rods, to secure the connecting rods with the two primary boards and the two secondary boards.

2. The magazine rack as claimed in claim 1, wherein the two primary boards are arranged symmetrically, and the two secondary boards are arranged symmetrically.

* * * * *